US009362644B2

(12) United States Patent
Sato et al.

(10) Patent No.: US 9,362,644 B2
(45) Date of Patent: Jun. 7, 2016

(54) CONNECTOR PAIR WITH PLATED CONTACTS

(71) Applicant: Japan Aviation Electronics Industry, Limited, Tokyo (JP)

(72) Inventors: Kazuomi Sato, Tokyo (JP); Sae Tsugawa, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 14/541,514

(22) Filed: Nov. 14, 2014

(65) Prior Publication Data

US 2015/0222036 A1 Aug. 6, 2015

(30) Foreign Application Priority Data

Jan. 31, 2014 (JP) ..... 2014-016869

(51) Int. Cl.

| | |
|---|---|
| ***H01R 9/24*** | (2006.01) |
| ***H01R 13/03*** | (2006.01) |
| ***H01R 24/60*** | (2011.01) |
| *H01R 107/00* | (2006.01) |

(52) U.S. Cl.

CPC ..... *H01R 13/03* (2013.01); *H01R 24/60* (2013.01); *H01R 2107/00* (2013.01)

(58) Field of Classification Search

USPC ..... 439/886

See application file for complete search history.

(56) References Cited

U.S. PATENT DOCUMENTS 4,785,137 A * 11/1988 Samuels ..... C22C 19/03 174/255
6,613,451 B1 * 9/2003 Asahara ..... C23C 2/02 205/226
7,029,760 B2 * 4/2006 Mori ..... B32B 15/017 205/226
2003/0186597 A1 10/2003 Suzuki et al.
2006/0260678 A1 11/2006 Nagao et al.

FOREIGN PATENT DOCUMENTS

| | | | |
|---|---|---|---|
| JP | 2004-6065 | A | 1/2004 |
| JP | 2008-169408 | A | 7/2008 |
| JP | 4302392 | B2 | 7/2009 |
| JP | 4429209 | B2 | 12/2009 |
| JP | 2010-159481 | A | 7/2010 |
| WO | 2011064640 | A1 | 6/2011 |

OTHER PUBLICATIONS

Extended European Search Report in 14196079.9, dated Apr. 2, 2015.

* cited by examiner

*Primary Examiner* — Tho D Ta
(74) *Attorney, Agent, or Firm* — Collard & Roe, P.C.

(57) ABSTRACT

A connector pair comprises a first connector and a second connector which are mateable with each other. The first connector includes a first contact having a first contact portion which has a first plating layer made of silver or silver alloy. The second connector includes a second contact having a second contact portion which has a second plating layer made of silver or silver alloy. The second contact portion has a contact start point and a final contact point. The second plating layer has Vickers hardness not less than 120 Hv but not more than 180 Hv. The Vickers hardness of the second plating layer is larger than Vickers hardness of the first plating layer. When the first connector and the second connector are mated with each other, the first contact portion slides on the second contact portion from the contact start point to the final contact point.

6 Claims, 8 Drawing Sheets

CONNECTOR PAIR WITH PLATED CONTACTS

CROSS REFERENCE TO RELATED APPLICATIONS

An applicant claims priority under 35 U.S.C. §119 of Japanese Patent Application No. JP2014-016869 filed Jan. 31, 2014.

BACKGROUND OF THE INVENTION

This invention relates to a connector pair comprising two connectors mateable with each other and, in particular, relates to two contacts which are brought into contact with each other when the connectors are mated with each other.

For example, this type of contact is disclosed in JP-B 4302392 (Patent Document 1), the content of which is incorporated herein by reference.

As can be seen from FIG. 16, Patent Document 1 discloses a male terminal (contact) which is inserted into a female terminal (contact) to be brought into contact with the female terminal when two connectors (not shown) are mated with each other. The female terminal has a projecting contact portion while the male terminal has a contact portion extending in a plane. The contact portion of the female terminal slides on the contact portion of the male terminal upon the mating of the connectors. Each of the contact portions is plated with tin or the like. In other words, each of the contact portions has a plating layer. The plating layer of the male terminal has Vickers hardness larger than Vickers hardness of the plating layer of the female terminal so as to lower an insertion force upon insertion of the male terminal into the female terminal.

From a point of view of making contact resistance of the contact portion lower, the contact portion is preferred to be plated with silver or silver alloy. In other words, the contact portion is preferred to have a soft silver plating layer or a hard silver plating layer formed on base metal thereof. However, although the soft silver plating layer has low contact resistance, the soft silver plating layer is so soft to be easily abraded by sliding between the contact portions. When the plating layer is abraded, the base metal is exposed to raise the contact resistance. Moreover, the hard silver plating layer tends to have lowered conductivity because of contained hardening agent and tends to have reduced contact area because of its hard surface. As a result, the hard silver plating layer tends to have relatively high contact resistance. Accordingly, a silver or silver alloy plating layer, which has low contact resistance and is hardly abraded, is required.

SUMMARY OF THE INVENTION

It is therefore an object of the present invention to provide a contact which is plated so as to satisfy this requirement.

One aspect of the present invention provides a connector pair comprising a first connector and a second connector which are mateable with each other. The first connector includes a first contact having a first contact portion which has a first plating layer made of silver or silver alloy. The second connector includes a second contact having a second contact portion which has a second plating layer made of silver or silver alloy. The second contact portion has a contact start point and a final contact point. The second plating layer has Vickers hardness not less than 120 Hv but not more than 180 Hv. The Vickers hardness of the second plating layer is larger than Vickers hardness of the first plating layer. When the first connector and the second connector are mated with each other, the first contact portion slides on the second contact portion from the contact start point to the final contact point to be connected to the second contact portion.

According to the present invention, the first contact portion of the first contact slides on the second contact portion of the second contact to be connected to the second contact portion. The Vickers hardness of the second plating layer of the second contact portion is larger than the Vickers hardness of the first plating layer of the first contact portion. Moreover, The Vickers hardness of the second plating layer is not less than 120 Hv but not more than 180 Hv. Because the first contact portion and the second contact portion are thus plated, the contact, which is plated with silver or silver alloy and which has low contact resistance and is hardly abraded, can be obtained.

An appreciation of the objectives of the present invention and a more complete understanding of its structure may be had by studying the following description of the preferred embodiment and by referring to the accompanying drawings.

Figure 1:
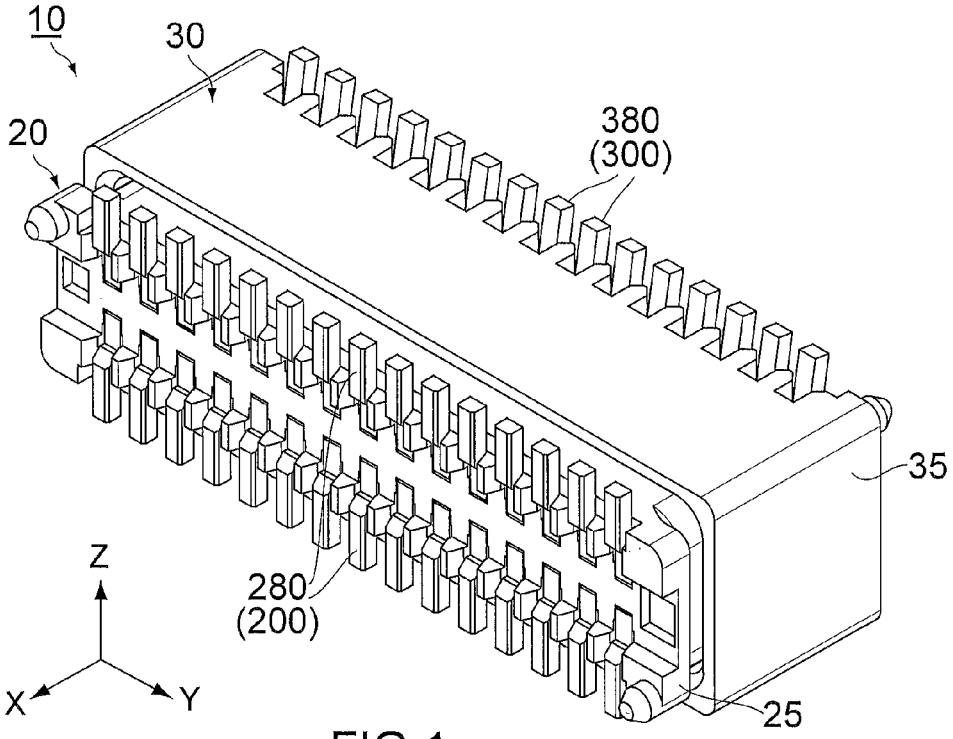
FIG. 1 is a perspective view showing a contact pair according to a first embodiment of the present invention, wherein a first connector and a second connector of the connector pair are mated with each other.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

As shown in FIGS. 1 to 4, a connector pair 10 according to a first embodiment of the present invention comprises a first connector 20 and a second connector 30 which are mateable with each other along the X-direction (front-rear direction: predetermined direction). In the present embodiment, each of the first connector 20 and the second connector 30 is an on-board connector that is to be mounted on a circuit board (not-shown). However, the present invention is applicable to a connector other than the on-board connector.

Figure 2:
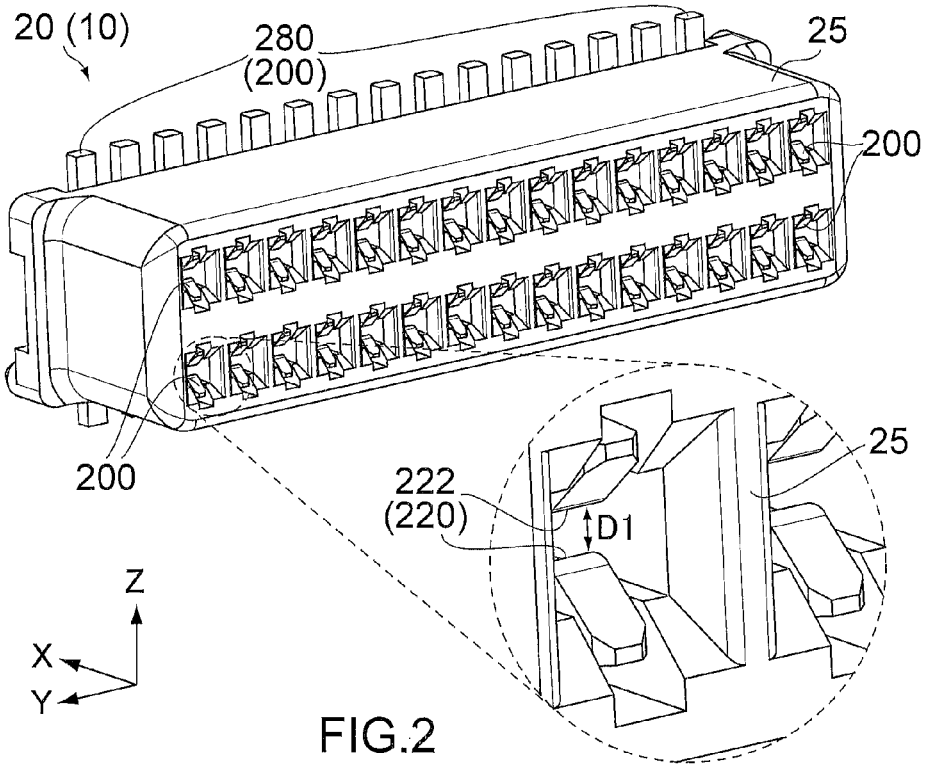
FIG. 2 is a perspective view showing the first connector of FIG. 1, wherein the vicinity of a first contact portion of a first contact of the first connector (the part encircled by dotted line) is enlarged to be illustrated.

As shown in FIG. 2, the first connector 20 includes a first housing 25 made of insulator and a plurality of first contacts 200 each made of conductor. The first housing 25 has a box-like shape extending long in the Y-direction (pitch direction). The first contacts 200 are held by the first housing 25. In detail, the first contacts 200 are separated into two rows in the Z-direction (upper-lower direction). The first contacts 200 in each row are arranged in the Y-direction.

Figure 5:
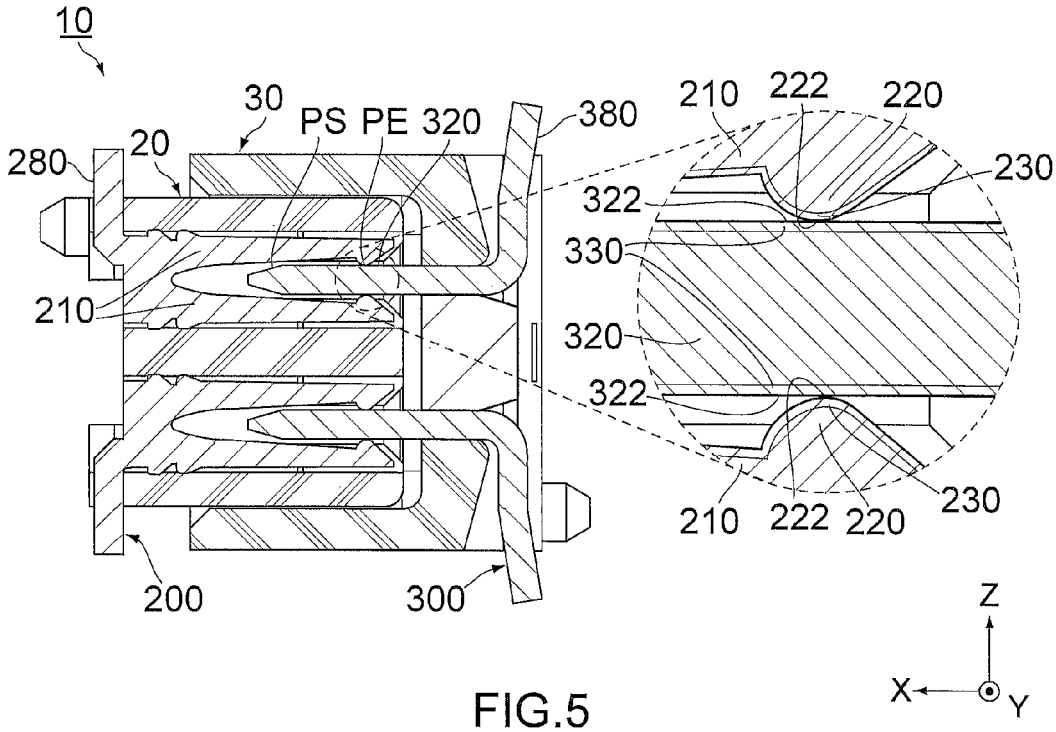
FIG. 5 is a cross-sectional view showing the contact pair of FIG. 4, taken along line V-V, wherein the vicinity of the first contact portion and the second contact portion (the part encircled by dotted line) is enlarged to be illustrated.

Referring to FIGS. 2 and 5, each of the first contacts 200 according to the present embodiment has two elastic supporting portions 210, two first connection portions 220 and a fixed portion 280. The elastic supporting portions 210 extend along the X-direction. Each of the first connection portions 220 has a projecting shape. The first connection portions 220 are supported by the elastic supporting portions 210, respectively. Each of the elastic supporting portions 210 is elastically deformable in the XZ-plane. Accordingly, each of the first connection portions 220 is movable in the Z-direction. The fixed portion 280 extends outward in the Z-direction from about the positive X-side end (rear end) of one of the elastic supporting portions 210. When the first connector 20 is mounted on a circuit board (not shown), the fixed portion 280 is fixed and connected to the circuit board by soldering or the like.

Referring to FIG. 5, each of the first contacts 200 has two first contact portions 222. The contact portions 222 face each other in the Z-direction when the first connector 20 is not mated with the second connector 30. The first contact portions 222 according to the present embodiment are provided so as to correspond to the two first connection portions 220, respectively. More specifically, the first contact portion 222 is a part, or a protruding end, of a corresponding one of the first connection portion 220. In other words, the first connection portion 220 includes the first contact portion 222 located at an end thereof. The first contact portion 222 is plated with silver or silver alloy that is alloy containing silver as a principal component. In detail, the first contact portion 222 has a base metal portion made of base metal such as copper (Cu) and copper alloy, and a first plating layer 230 made of silver or silver alloy, wherein the first plating layer 230 covers the base metal portion. Not only the first plating layer 230 but also the base metal portion has low electric resistivity. Accordingly, the first contact 200 has superior conductivity.

Figure 3:
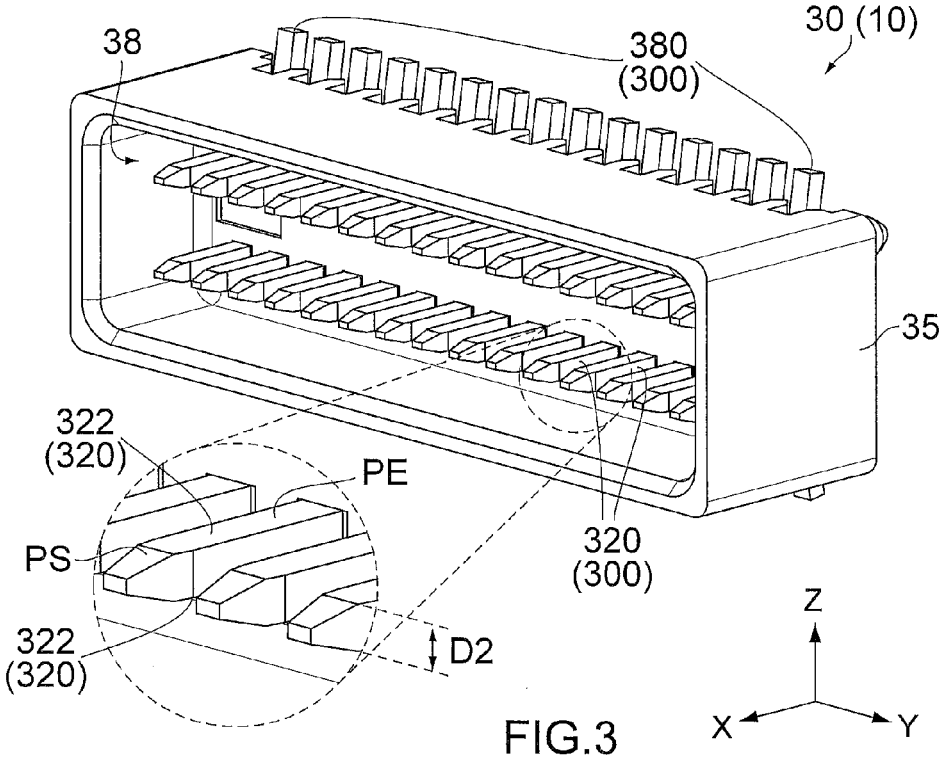
FIG. 3 is a perspective view showing the second connector of FIG. 1, wherein the vicinity of a second contact portion of a second contact of the second connector (the part encircled by dotted line) is enlarged to be illustrated.
Figure 4:
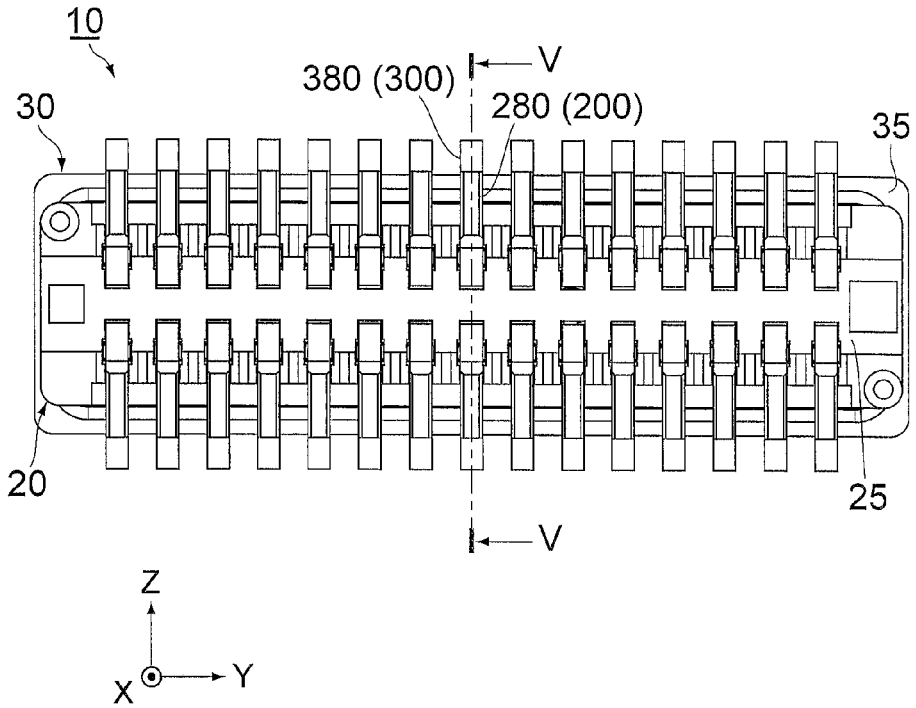
FIG. 4 is a front view showing the contact pair of FIG. 1.

As shown in FIG. 3, the second connector 30 includes a second housing 35 made of insulator and a plurality of second contacts 300 each made of conductor. The second housing 35 has a box-like shape extending long in the Y-direction. The second housing 35 has a receive portion 38 formed therewithin. The second contacts 300 are held by the second housing 35 so as to correspond to the first contacts 200 (see FIG. 2), respectively. In detail, the second contacts 300 are separated into two rows in the Z-direction. The second contacts 300 in each row are arranged in the Y-direction.

As shown in FIGS. 3 and 5, each of the second contacts 300 according to the present embodiment has a second connection portion 320 and a fixed portion 380. The second connection portion 320 extends along the X-direction in the receive portion 38. The second connection portion 320 according to the present embodiment has an upper surface (positive Z-side surface) and a lower surface (negative Z-side surface) which extend in the XY-plane. The fixed portion 380 extends outward in the Z-direction from about the negative X-side end (rear end) of the second connection portion 320. When the second connector 30 is mounted on a circuit board (not shown), the fixed portion 380 is fixed and connected to the circuit board by soldering or the like.

Referring to FIG. 5, each of the second contacts 300 has two second contact portions 322. Each of the second contact portions 322 according to the present embodiment is a part of the second connection portion 320. In detail, the second contact portions 322 are an upper surface part and a lower surface part of the second connection portion 320, respectively, wherein the upper surface part includes the upper surface and the lower surface part includes the lower surface. In other words, the second connection portion 320 has the second contact portions 322 which are located at the upper surface part and the lower surface part thereof, respectively. The second contact portion 322 is plated with silver or silver alloy similar to the first contact portion 222. In detail, the second contact portion 322 has a base metal portion made of base metal such as copper and copper alloy, and a second plating layer 330 made of silver or silver alloy, wherein the second plating layer 330 covers the base metal portion. Accordingly, the second contact 300 has superior conductivity similar to the first contact 200.

Under a mated state (a state shown in FIG. 5) where the first connector 20 and the second connector 30 are completely mated with each other, the second contact portion 322 is stably in contact with the first contact portion 222. More specifically, the first contact portion 222 is pressed against the second contact portion 322 along the Z-direction with a predetermined contact force. As described above, each of the first plating layer 230 and the second plating layer 330 is the silver or silver alloy plating which has low electric resistivity. Moreover, the first contact portion 222 and the second contact portion 322 have low contact resistance therebetween.

In general, if the first contact portion 222 and the second contact portion 322 has high contact resistance therebetween, large Joule heat is generated when large electric current flows. Accordingly, temperature of each of the first contact 200 and the second contact 300 is raised. In particular, when the temperature of the first contact 200 is raised, spring force of the elastic supporting portions 210 of the first contact 200 is weakened so that the contact force of the first contact portion 222 is lowered. As a result, the contact resistance between the first contact portion 222 and the second contact portion 322 further becomes higher to further generate larger Joule heat. As can be seen from the above explanation, the contact resistance between the first contact portion 222 and the second contact portion 322 seriously affects long-term reliability of the first connector 20. As described below, according to the present embodiment, the reliability of the first connector 20 can be improved.

As shown in FIG. 2, under an unmated state where the first connector 20 and the second connector 30 are not yet mated, the two first contact portions 222 of the first contact 200 are apart from each other by a distance D1 in the Z-direction. As shown in FIG. 3, the second connection portion 320 of the second contact 300 has a size D2 in the Z-direction. D2 is slightly larger than D1.

As can be seen from FIGS. 2 and 3, when the first connector 20 and the second connector 30 are mated with each other, the first connector 20 is inserted into the receive portion 38 of the second connector 30. At that time, first, the second connection portion 320 of the second connector 30 is inserted and sandwiched between the two first contact portions 222 of the first contact 200. Then, the first contact portion 222 of the first contact 200 slides on the second contact portion 322 of the second contact 300 along the X-direction while being pressed against the second contact portion 322.

In detail, referring to FIG. 5, the second contact portion 322 has a contact start point PS and a final contact point PE. The first contact portion 222 is firstly brought into abutment with the contact start point PS. Then, the first contact portion 222 is moved relative to the second contact portion 322 along the negative X-direction while sliding on the second contact portion 322. Under the mated state (the state shown in FIG. 5), the first contact portion 222 is located at the final contact point PE. As can be seen from the above explanation, when the first connector 20 and the second connector 30 are mated with each other, the first contact portion 222 slides on the second contact portion 322 from the contact start point PS to the final contact point PE to be connected to the second contact portion 322. In the meantime, the first contact portion 222 is pressed against the second contact portion 322 in the Z-direction by the predetermined contact force. In the meantime, a constant section of the first contact portion 222 is kept to be in contact with the second contact portion 322. In contrast, the second contact portion 322 continuously changes its section that is in contact with the first contact portion 222.

In general, when a soft plating layer slides while being pressed against another soft plating layer, each of the plating layers tends to be abraded. If the first plating layer 230 is abraded, the base metal portion (Cu) of the first contact portion 222 is partially exposed so that the base metal portion of the first contact portion 222 and the second plating layer 330 are brought into contact with each other. As a result, the contact resistance between the first contact portion 222 and the second contact portion 322 is raised.

However, according to the present embodiment, the second plating layer 330 of the second contact portion 322 has Vickers hardness larger than Vickers hardness of the first plating layer 230 of the first contact portion 222. This feature makes it possible to effectively lower abrasion of the first plating layer 230 and the second plating layer 330, in particular, the abrasion of the second plating layer 330. Moreover, the Vickers hardness of the second plating layer 330 is not less than 120 Hv but not more than 180 Hv. Under this condition, the contact resistance between the first contact portion 222 and the second contact portion 322 can be lowered relatively.

However, when the Vickers hardness of the second plating layer 330 is over 140 Hv, the contact resistance becomes higher as hardness difference between the Vickers hardness of the second plating layer 330 and the Vickers hardness of the first plating layer 230 becomes larger. Accordingly, it is more preferable that the Vickers hardness of the second plating layer 330 is not less than 120 Hv but not more than 140 Hv. Under this condition, the contact resistance can be kept almost constant regardless of the hardness difference.

It is preferable that the hardness difference between the Vickers hardness of the first plating layer 230 and the Vickers hardness of the second plating layer 330 is larger than 0 Hv but not more than 100 Hv. Under this condition, exposure of the base metal portion due to abrasion can be more effectively prevented.

The present embodiment can be modified variously.

For example, referring to FIG. 5, whole of the first contact 200 may be uniformly plated, while only the first connection portion 220 of the first contact 200 may be plated as described above. Similarly, the second contact 300 may be plated differently depending on its part. Moreover, the base metal portion of the first contact 200 or the second contact 300 may be plated with base plating such as Ni. In this case, the base plating is further plated on its surface with plating made of silver or silver alloy so that the first contact 200 or the second contact 300 can be formed.

Referring to FIGS. 2 and 3, the first connection portions 220 open in the Z-direction while the second connection portion 320 has a rectangular rod-like shape. However, each of the first connection portion 220 and the second connection portion 320 may have any shape, provided that the first connection portion 220 slides on the second connection portion 320. For example, the second connection portion 320 may have a plate-like shape or a rod-like shape. In other words, each of the first contact 200 and the second contact 300 may have any shape.

Second Embodiment

Figure 6:
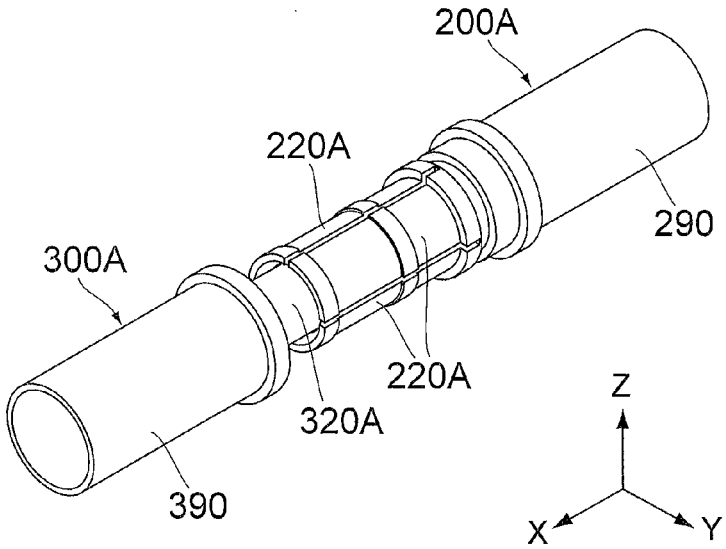
FIG. 6 is a perspective view showing a first contact and a second contact according to a second embodiment of the present invention, wherein the second contact is inserted in the first contact.
Figure 7:
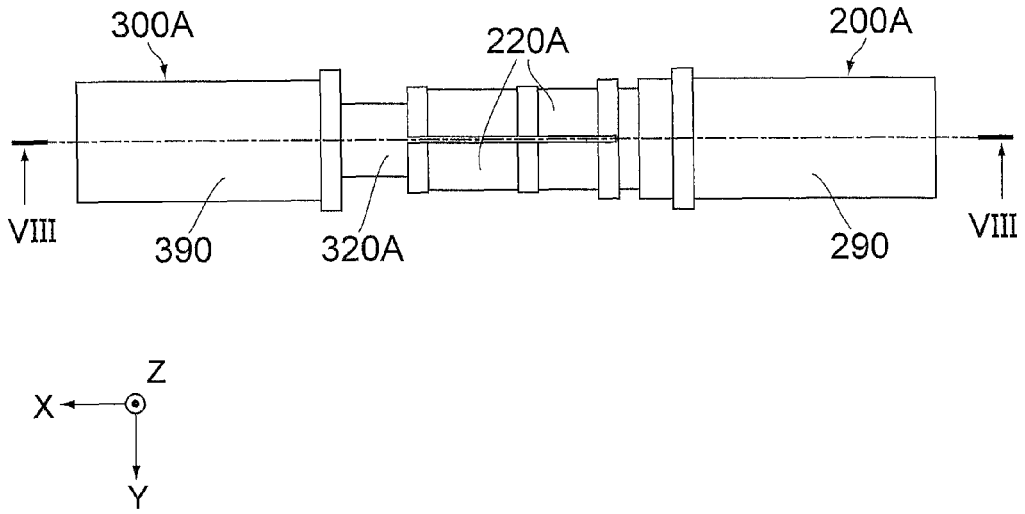
FIG. 7 is a top view showing the first contact and the second contact of FIG. 6.
Figure 8:
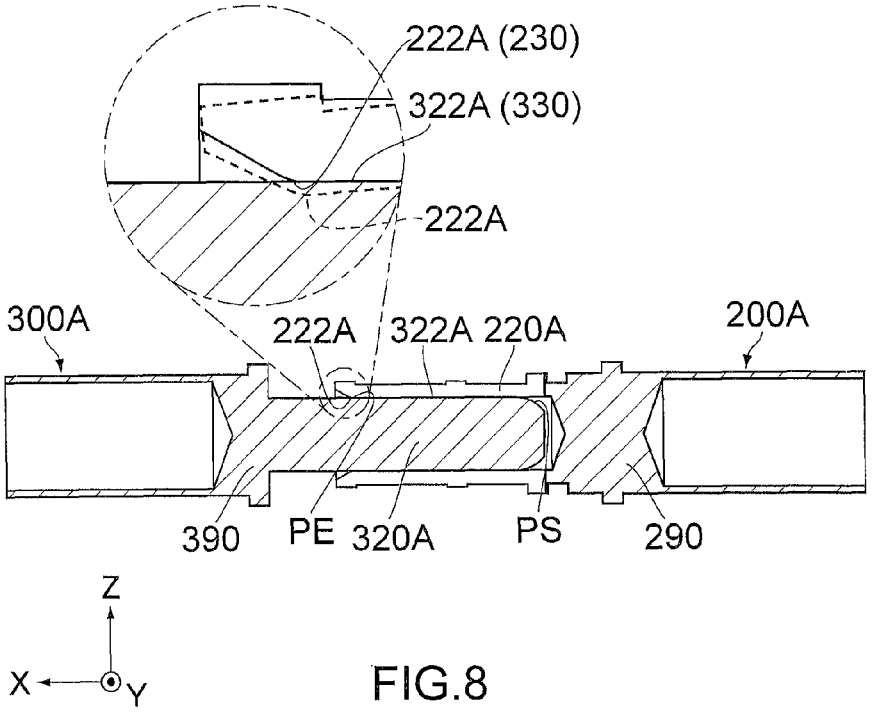
FIG. 8 is a cross-sectional view showing the first contact and the second contact of FIG. 7, taken along line VIII-VIII, wherein the vicinity of a first contact portion of the first contact (the part encircled by chain dotted line) is enlarged to be illustrated, and an outline of the first contact portion prior to the insertion of the second contact into the first contact is illustrated by dotted line.

Referring to FIGS. 6 to 8, a connector pair (not shown) according to a second embodiment of the present invention comprises a first connector (not shown) and a second connector (not shown) mateable with each other. The first connector includes a first contact 200A made of conductive material, and the second connector includes a second contact 300A made of conductive material.

As shown in FIGS. 6 to 8, the first contact 200A has a plurality of first connection portions 220A and a base portion 290. According to the present embodiment, the number of the first connection portions 220A is four. The first connection portions 220A extend along the positive X-direction from the base portion 290 to have a cylindrical shape as a whole. In other words, the first connection portions 220A form an imaginary cylinder. Each of the first connection portions 220A is elastically deformable in a radius direction of the cylinder. Accordingly, each of the first connection portions 220A functions as an elastic supporting portion similar to the elastic supporting portion 210 (see FIG. 5) of the first contact 200.

Referring to FIG. 8, the first contact 200A has four first contact portions 222A. The first contact portions 222A according to the present embodiment are provided so as to correspond to the four first connection portions 220A, respectively. In detail, the first contact portion 222A is a part, or an end portion in the positive X-direction, of a corresponding one of the first connection portions 220A. In other words, the first connection portion 220A has the first contact portion 222A located at the end thereof. The first contact portion 222A is plated with silver or silver alloy similar to the first contact portion 222 (see FIG. 5). In other words, the first contact portion 222A has a base metal portion similar to that of the first contact portion 222 and the first plating layer 230 made of silver or silver alloy, wherein the first plating layer 230 covers the base metal portion.

As shown in FIGS. 6 to 8, the second contact 300A according to the present embodiment has a second connection portion 320A and a base portion 390. The second connection portion 320A extends along the negative X-direction from the base portion 390 to have a rounded pin shape.

As shown in FIG. 8, the second contact 300A has a second contact portion 322A. The second contact portion 322A according to the present embodiment is a part of the second connection portion 320A. In detail, the second contact portion 322A is a surface layer of a columnar shape of the second connection portion 320A. In other words, the second connection portion 320A has the second contact portion 322A which is located at the surface layer thereof. The second contact portion 322A is plated with silver or silver alloy similar to the second contact portion 322 (see FIG. 5). In detail, the second contact portion 322A has a base metal portion made of, for example, copper or copper alloy, and a second plating layer 330 made of silver or silver alloy, wherein the second plating layer 330 covers the base metal portion.

As can be seen from FIG. 8, when the second contact 300A is not inserted in the first contact 200A, the first connection portion 220A is slightly inclined inward so that the first contact portion 222A is slightly close toward a central axis of the imaginary cylinder formed of the four first connection portions 220A. Accordingly, the imaginary cylinder has a narrow open end where the first contact portions 222A are located. In detail, an internal diameter of the open end is smaller than another internal diameter of the deeper side of the imaginary cylinder, or the side which is located in the vicinity of the base portion 290. Moreover, similar to the first embodiment, the second contact portion 322A has a contact start point PS and a final contact point PE for each of the first contact portions 222A. When the first connector (not shown) and the second connector (not shown) are mated with each other, the first contact portion 222A slides on the second contact portion 322A from the contact start point PS to the final contact point PE. According to the present embodiment, similar to the first embodiment, the abrasion of the second plating layer 330 of the second contact portion 322A can be reduced by adjusting the Vickers hardness of each of the first plating layer 230 and the second plating layer 330.

The present embodiment can be modified variously. For example, similar to the first contact portion 222 according to the first embodiment, the first contact portion 222A may be shaped in a projecting shape. Moreover, the number of the first connection portions 220A is not limited to four. It is sufficient that the first contact 200A has two or more of the first connection portions 220A and two or more of the first contact portions 222A.

The present invention can be variously applicable in addition to the embodiments described above. For example, a sliding direction along which the first contact portion slides on the second contact portion may be different from the mating direction (predetermined direction) along which the first connector and the second connector are mated with each other.

EXAMPLES

Hereafter, explanation is made further specifically about the first plating layer 230 and the second plating layer 330 according to the aforementioned embodiments of the present invention as referring to Examples and Comparative Examples.

Figure 9:
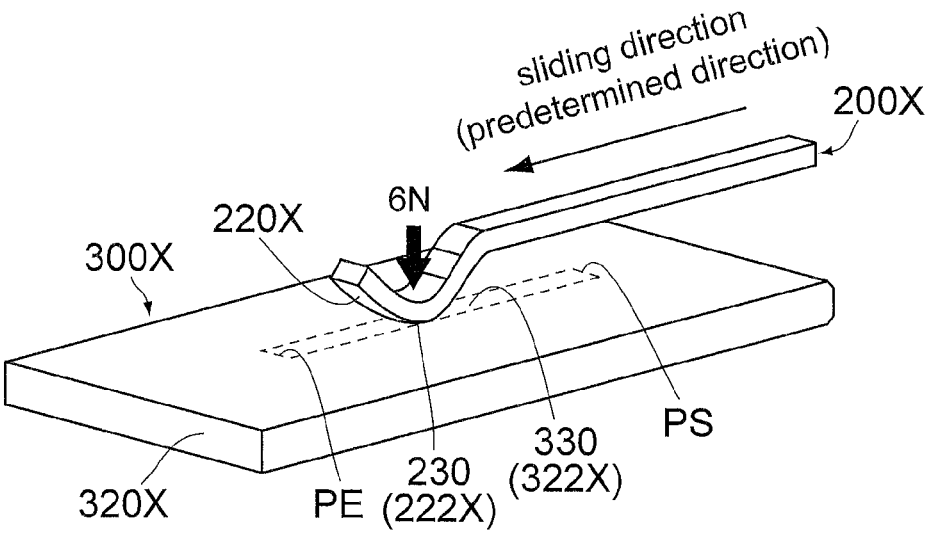
FIG. 9 is a perspective view schematically showing a part of a first contact and a part of a second contact according to examples of the present invention.

As shown in FIG. 9, according to Examples and Comparative Examples of the present invention, a first contact 200X is a socket contact having a first connection portion 220X of projecting shape while a second contact 300X is a pin contact having a second connection portion 320X of plate-like shape. The first connection portion 220X has a first contact portion 222X extending linearly while the second connection portion 320X has a second contact portion 322X extending planarly. The first contact portion 222X is formed with the first plating layer 230 made of silver or silver alloy while the second contact portion 322X is formed with the second plating layer 330 made of silver or silver alloy. Moreover, the second contact portion 322X has a contact start point PS and a final contact point PE.

The first contact portion 222X that was formed as described above was forced to slide on the second contact portion 322X so that friction coefficient, contact resistance and exposed number were measured, wherein the exposed number was number of times of sliding until base metal portion (Cu) was exposed. The measurement was performed for various combinations of the Vickers hardness of the first plating layer 230 and the Vickers hardness of the second plating layer 330.

More specifically, the base metal portions of the second contact portions 322X of four of the second contacts 300X were plated with four types materials, respectively, wherein the materials had different Vickers hardness from one another. Each of the materials was made of silver or silver alloy. By this plating, the second plating layers 330 of Example 1, Example 2, Comparative Example 1 and Comparative Example 2, which were formed of different materials, were obtained. Similarly, the base metal portions of the first contact portions 222X of four of the first contacts 200X were plated with four types of materials, respectively, wherein the materials had different Vickers hardness from one another. Each of the materials was made of silver or silver alloy. By this plating, the first plating layers 230 of Example 3, Example 4, Comparative Example 3 and Comparative Example 4, which were formed of different materials, were obtained. The friction coefficient, the contact resistance and the exposed number were measured for all combinations of the second plating layers 330 of Example 1, Example 2, Comparative Example 1 and Comparative Example 2 and the first plating layers 230 of Example 3, Example 4, Comparative Example 3 and Comparative Example 4.

(Measurement of the Vickers Hardness)

Vickers hardness at plating surface was measured for each Example and for each Comparative Example. Applied load on measurement of the Vickers hardness was 0.098N. The Vickers hardness of the second plating layers 330 of Example 1, Example 2, Comparative Example 1 and Comparative Example 2 were 74.5 Hv, 132.1 Hv, 174.8 Hv and 209.2 Hv, respectively. The Vickers hardness of the first plating layers 230 of Example 3, Example 4, Comparative Example 3 and Comparative Example 4 were 83.2 Hv, 155.2 Hv, 184.2 Hv and 209.3 Hv, respectively.

(Measurement of Crystal Grain Size)

Crystal grain size was measured for each of the second plating layers 330 of Comparative Example 1, Example 1, Example 2 and Comparative Example 2. In detail, Ion Milling Apparatus (IM4000) of Hitachi High-Technologies Corporation was used to irradiate argon ion beam to a surface of the second plating layer 330 by 10 minutes for sputtering. Thus-processed surface after the sputtering was observed at fifty thousand magnifications by using Scanning Electron Microscope (JSM-6610) of JEOL Ltd. An average crystal grain size of the observed ten crystal grains was calculated to be used as the crystal grain size. The calculated crystal grain sizes are shown in Table 1.

TABLE 1

| | Comparative Example 1 | Example 1 | Example 2 | Comparative Example 2 |
|---|---|---|---|---|
| Vickers Hardness [Hv] | 74.5 | 132.1 | 174.8 | 209.2 |
| Crystal Grain Size [μm] | 0.68 | 0.19 | 0.14 | 0.11 |

As can be seen from Table 1, the Vickers hardness is larger as the crystal grain size is smaller.

(Measurement of the Friction Coefficient)

Figure 10:
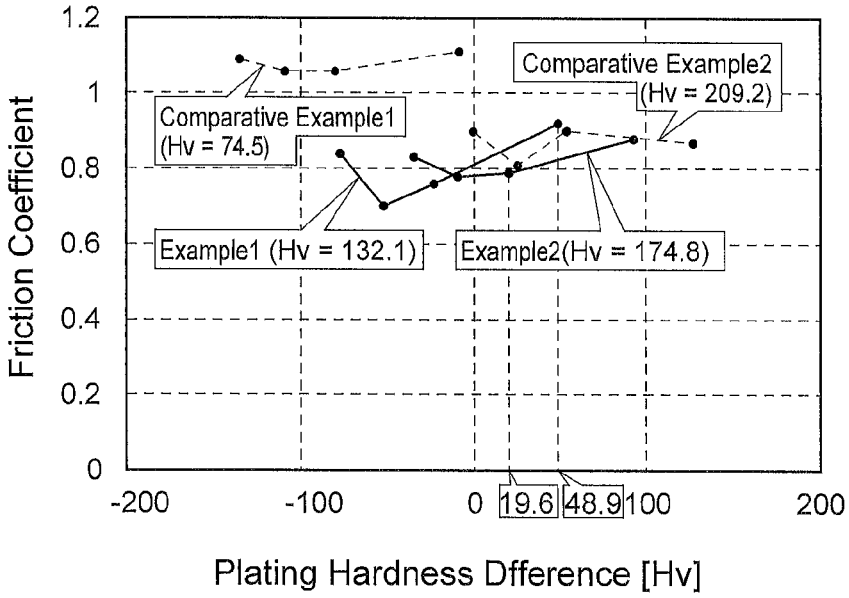
FIG. 10 is a view showing four graphs corresponding to four types of second plating layers, respectively, wherein each graph shows friction coefficient versus plating hardness difference that is relative Vickers hardness of the second plating layer of the second contact to Vickers hardness of a first plating layer of the first contact, and the friction coefficient was measured under a condition where the first contact was forced to slide on the second contact as shown in FIG. 9.
Figure 13:
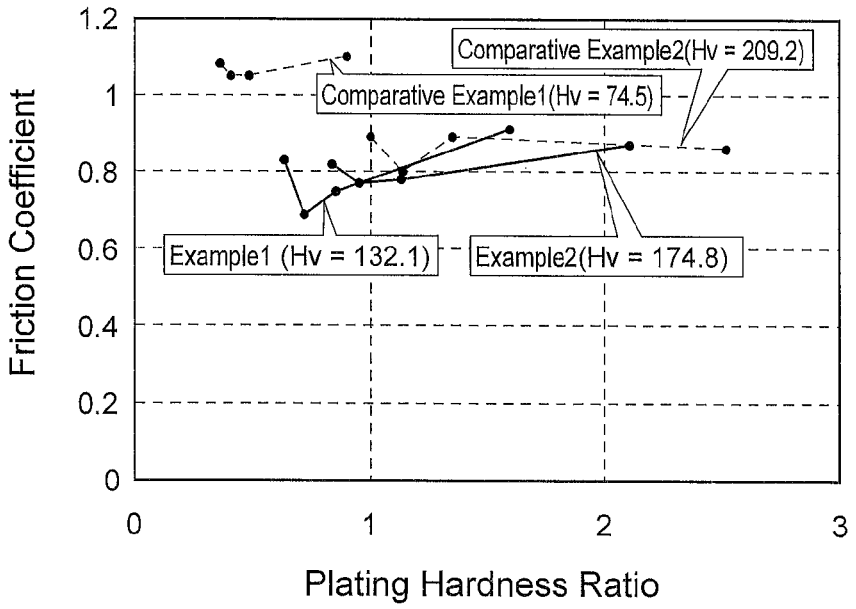
FIG. 13 is a view showing four graphs corresponding to the four graphs of FIG. 10, respectively, wherein each graph shows the friction coefficient versus plating hardness ratio that is ratio of the Vickers hardness of the second plating layer to the Vickers hardness of the first plating layer.

Referring to FIG. 9, the first contact portion 222X was forced to slide from the contact start point PS to the final contact point PE while a load of 6N was applied to the first contact portion 222X along a vertical direction. The friction coefficient between the first plating layer 230 and the second plating layer 330 under this sliding (dynamic coefficient of friction) was measured for each of Comparative Example 1, Example 1, Example 2 and Comparative Example 2 (see line graphs in FIGS. 10 and 13). Each line graph in FIG. 10 shows the friction coefficient versus plating hardness difference that is relative Vickers hardness of the second plating layer 330 to the Vickers hardness of the first plating layer 230. Each line graph in FIG. 13 shows the friction coefficient versus plating hardness ratio that is ratio of the Vickers hardness of the second plating layer 330 to the Vickers hardness of the first plating layer 230.

(Measurement of the Contact Resistance)

Figure 11:
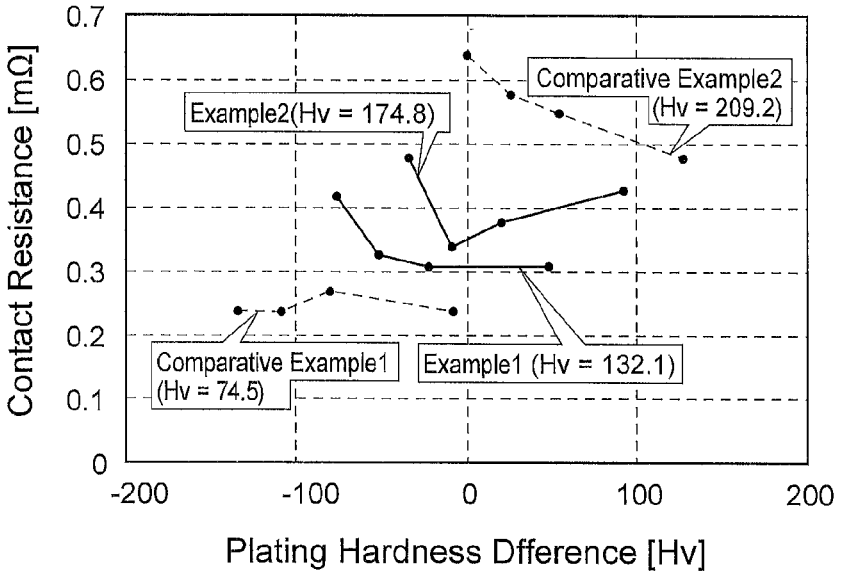
FIG. 11 is a view showing four graphs corresponding to the four types of the second plating layers, respectively, wherein each graph shows contact resistance between the first contact and the second contact of FIG. 9 versus the plating hardness difference.
Figure 14:
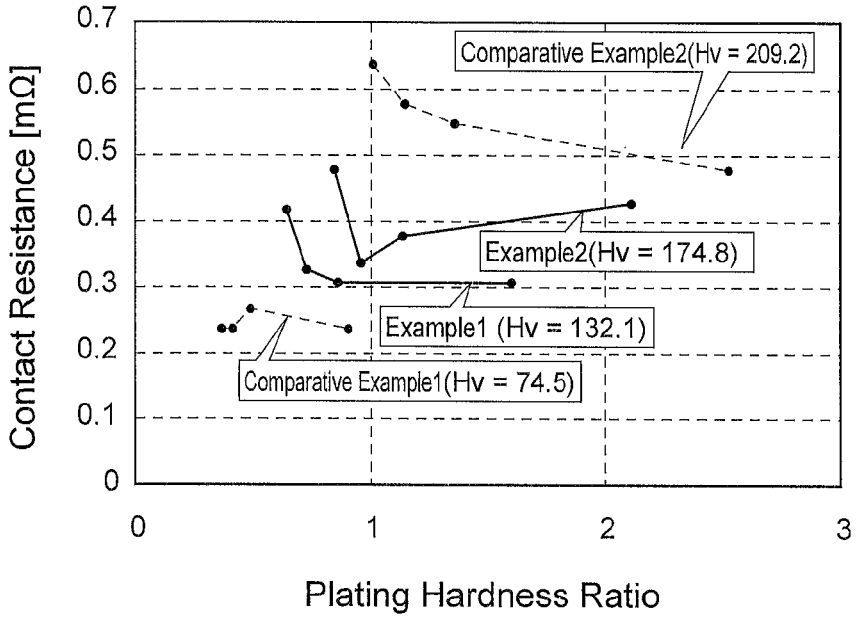
FIG. 14 is a view showing four graphs corresponding to the four graphs of FIG. 11, respectively, wherein each graph shows the contact resistance versus the plating hardness ratio.

The contact resistance between the first plating layer 230 and the second plating layer 330 was measured under a condition where the load of 6N was applied to the first contact portion 222X along the vertical direction. The measurement was performed for each of Comparative Example 1, Example 1, Example 2 and Comparative Example 2 (see line graphs in FIGS. 11 and 14). Each line graph in FIG. 11 shows the contact resistance versus the plating hardness difference. Each line graph in FIG. 14 shows the contact resistance versus the plating hardness ratio.

(Measurement of the Exposed Number)

Figure 12:
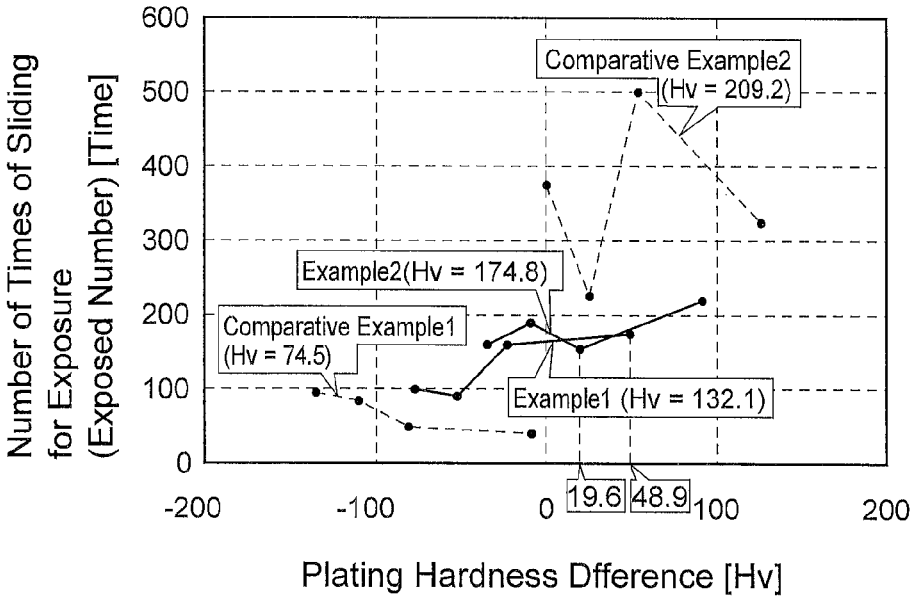
FIG. 12 is a view showing four graphs corresponding to the four types of the second plating layers, respectively, wherein each graph shows exposed number versus the plating hardness difference, and the exposed number is number of times of sliding for exposure of base metal under a condition where the first contact was repeatedly forced to slide on the second contact as shown in FIG. 9.
Figure 15:
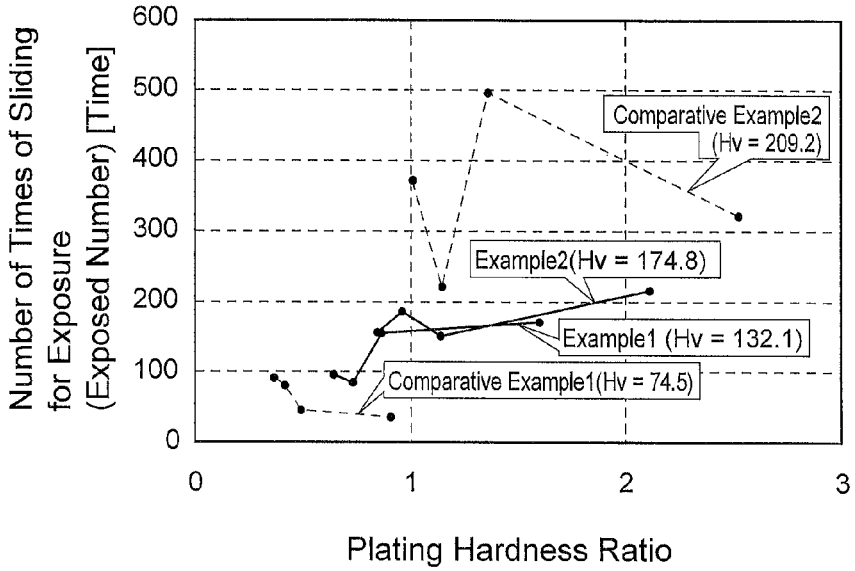
FIG. 15 is a view showing four graphs corresponding to the four graphs of FIG. 12, respectively, wherein each graph shows the exposed number versus the plating hardness ratio.
Figure 16:
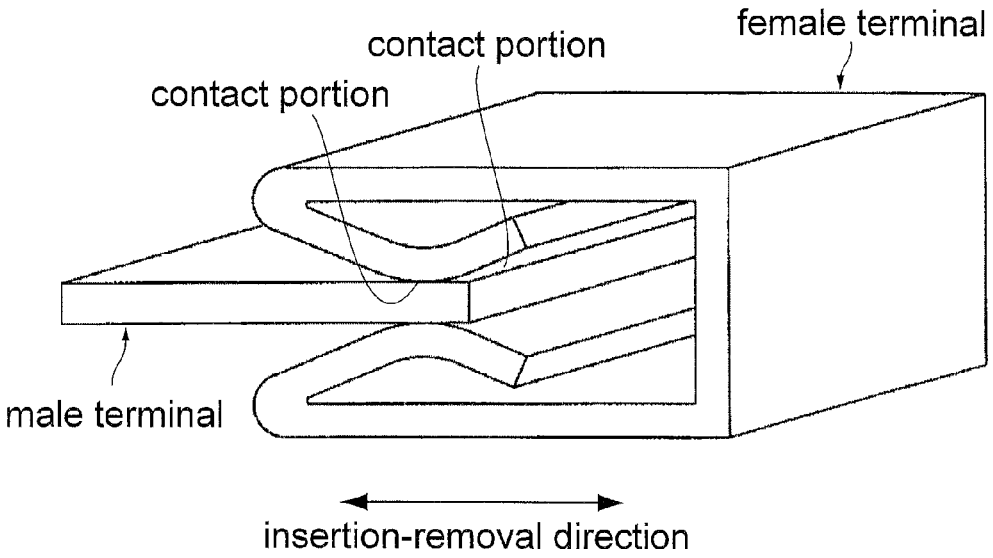
FIG.16 PRIOR ART
FIG. 16 is a perspective view showing a male terminal and a female terminal of Patent Document 1.

The aforementioned sliding of the first contact portion 222X on the second contact portion 322X was repeatedly performed so that the exposed number was measured, wherein the exposed number was the number of times of sliding until the second plating layer 330 was abraded to expose the base metal portion of copper. The measurement was performed for each of Comparative Example 1, Example 1, Example 2 and Comparative Example 2 (see line graphs in FIGS. 12 and 15). Each line graph in FIG. 12 shows the exposed number versus the plating hardness difference. Each line graph in FIG. 15 shows the exposed number versus the plating hardness ratio.

(Evaluation of the Measurement)

As can be seen from FIGS. 10, 12, 13 and 15 (in particular, see Examples 1 and 2), the exposed number is large when the plating hardness difference is more than 0 but not more than 100 Hv (according to the present measurement, in a range between 19.6 Hv and 48.9 Hv, both inclusive). In other words, the exposed number is large when the plating hardness ratio is more than 1. Accordingly, when the Vickers hardness of the second plating layer 330 is larger than the Vickers hardness of the first plating layer 230, the exposure of the base metal portion due to the abrasion can be reduced so that the contact resistance can be prevented from being raised.

As can be seen from FIGS. 11 and 14, the contact resistance becomes higher as the Vickers hardness of the second plating layer 330 becomes larger. However, under a condition where the plating hardness difference is more than 0 (the plating hardness ratio is more than 1) and the Vickers hardness of the second plating layer 330 is not less than 120 Hv but not more than 180 Hv (see Examples 1 and 2), the contact resistance is relatively low and the second plating layer 330 is hardly abraded. In other words, abrasion resistance property upon sliding and contact resistance property are improved. Moreover, when the Vickers hardness of the second plating layer 330 is not less than 120 Hv but not more than 140 Hv, the abrasion resistance property upon sliding is further improved. In addition, the contact resistance can be kept almost constant regardless of the plating hardness difference. In other words, the contact resistance property is further improved.

The present application is based on a Japanese patent application of JP2014-016869 filed before the Japan Patent Office on Jan. 31, 2014, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector pair comprising a first connector and a second connector which are mateable with each other, wherein:

the first connector includes a first contact having a first contact portion which has a first plating layer made of silver or silver alloy and having Vickers hardness not less than 83.2 Hv;

the second connector includes a second contact having a second contact portion which has a second plating layer made of silver or silver alloy;

the second contact portion has a contact start point and a final contact point;

the second plating layer has Vickers hardness not less than 120 Hv but not more than 180 Hv;

the Vickers hardness of the second plating layer is larger than Vickers hardness of the first plating layer;

when the first connector and the second connector are mated with each other, the first contact portion slides on the second contact portion from the contact start point to the final contact point to be connected to the second contact portion; and when the first contact portion is connected to the second contact portion, a contact resistance between the first contact portion and the second contact portion is between 0.3 mΩ and 0.5 mΩ.

2. The connector pair as recited in claim 1, wherein the Vickers hardness of the second plating layer is not less than 120 Hv but not more than 140 Hv.

3. The connector pair as recited in claim 1, wherein:

the first connector and the second connector are to be mated with each other along a predetermined direction; and when the first connector and the second connector are mated with each other, the first contact portion slides on the second contact portion along the predetermined direction.

4. The connector pair as recited in claim 1, wherein:

the first contact has an elastic supporting portion and a first connection portion;

the first connection portion has a projecting shape and is supported by the elastic supporting portion;

the first contact portion is a part of the first connection portion;

the second contact has a second connection portion;

the second connection portion has a plate-like shape or a rod-like shape; and the second contact portion is a part of the second connection portion.

5. The connector pair as recited in claim 1, wherein:

the first contact has two or more of first connection portions and two or more of the first contact portions corresponding to the first connection portions, respectively;

the first connection portions has a cylindrical shape as a whole;

each of the first connection portions functions as an elastic supporting portion;

each of the first contact portions is a part of a corresponding one of the first connection portion;

the second contact has a second connection portion;

the second connection portion has a rounded pin shape; and the second contact portion is a part of the second connection portion.

6. The connector as recited in claim 1, wherein a difference between the Vickers hardness of the first plating layer and the Vickers hardness of the second plating layer is larger than 0 Hv but not more than 100 Hv.

* * * * *